US009958810B2

(12) United States Patent
Furukawa

(10) Patent No.: US 9,958,810 B2
(45) Date of Patent: May 1, 2018

(54) BELT UNIT, TRANSFER UNIT AND IMAGE FORMATION APPARATUS

(71) Applicant: Oki Data Corporation, Tokyo (JP)

(72) Inventor: Takaaki Furukawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days. days.

(21) Appl. No.: 15/279,476

(22) Filed: Sep. 29, 2016

(65) Prior Publication Data

US 2017/0097592 A1 Apr. 6, 2017

(30) Foreign Application Priority Data

Oct. 1, 2015 (JP) ..... 2015-195868

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
USPC ..... 399/121, 162, 165, 167, 297, 299, 301, 399/302, 308
See application file for complete search history.

(56) References Cited

U.S. PATENT DOCUMENTS 7,136,611 B1 * 11/2006 Murase ..... G03G 15/1615 399/162
7,860,430 B2 * 12/2010 Saka ..... G03G 15/11 399/101
8,150,281 B2 * 4/2012 Kawaguchi ..... G03G 15/1615 399/300
8,233,822 B2 * 7/2012 Kim ..... G03G 15/161 399/162
8,233,823 B2 * 7/2012 Adachi ..... G03G 15/161 198/840

FOREIGN PATENT DOCUMENTS

JP 2011-107340 A 6/2011

* cited by examiner

*Primary Examiner* — Hoan Tran
(74) *Attorney, Agent, or Firm* — Metrolexis Law Group PLLC

(57) ABSTRACT

A belt unit includes: a belt member; a roller rotatably placed on an inner peripheral surface of the belt member; and a meander restraint member facing an edge portion of the belt member and configured to restrain the belt member from meandering while the belt member is running. The edge portion of the belt member includes a modification layer.

19 Claims, 8 Drawing Sheets

Fig. 5

| THICKNESS OF CARBONIZATION LAYER [μm] | PRESENCE OR ABSENCE OF BREAK | AMOUNT OF WEAR OF PULLEY [mm] | RESULT OF EVALUATION |
|---|---|---|---|
| 0 | BREAK WITH 200K TURNS | 0.50 | NO GOOD |
| 2 | NO BREAK WITH 400K TURNS | 0.70 | GOOD |
| 5 | NO BREAK WITH 400K TURNS | NOTHING (0.05 OR LESS) | GOOD |
| 10 | NO BREAK WITH 400K TURNS | NOTHING (0.05 OR LESS) | GOOD |

BELT UNIT, TRANSFER UNIT AND IMAGE FORMATION APPARATUS

CROSS REFERENCE TO RELATED APPLICATIONS

This application claims priority based on 35 USC 119 from prior Japanese Patent Application No. 2015-195868 filed on Oct. 1, 2015, entitled "BELT UNIT, TRANSFER UNIT AND IMAGE FORMATION APPARATUS", the entire contents of which are incorporated herein by reference.

BACKGROUND OF THE INVENTION

1. Field of the Invention

This disclosure relates to a belt unit, a transfer unit and an image formation apparatus.

2. Description of Related Art

As an example of conventional image formation apparatuses such as a printer, a copy machine, a facsimile machine, and a multifunction machine, an electrophotographic printer forms an image on a paper sheet as follows. First, the surface of a photosensitive drum is uniformly charged by a charge roller, and then is exposed to light from an LED head to form an electrostatic latent image. Next, a development unit develops the electrostatic latent image to form a toner image on the photosensitive drum, and then the toner image is transferred and fixed onto the paper sheet to form the image.

The printer is provided with a transfer belt unit as a belt unit that transfers the toner image to the paper sheet. There are two types of transfer belt units. One is configured to directly transfer the toner image from the photosensitive drum to the paper sheet conveyed by a transfer belt as a belt member. The other is configured to transfer the toner image to a transfer belt, and thereafter transfer the toner image from the transfer belt to the paper sheet. For either type of transfer belt unit, the transfer belt is made to run by a drive roller, an idle roller and the like being rotated.

If while running, the transfer belt meanders by moving in its width direction, the toner image cannot be properly transferred to the paper sheet or the transfer belt.

In view of this, a pulley as a meander restraint member is provided to an end portion of a predetermined one of the drive roller, the idle roller and the like, for example to an end portion of the idle roller, in order to prevent the meandering of the transfer belt (see Japanese Patent Application Publication No. 2011-107340 (Patent Document 1)).

SUMMARY OF THE INVENTION

However, in the above-mentioned conventional transfer belt unit, the transfer belt may damage the pulley when the transfer belt and the pulley slide over each other. In this case, if the transfer belt is caught by the scratch of the pulley, the transfer belt may break. A result of that is deterioration in the durability of the printer.

An object of an embodiment of the invention is to provide a belt unit, a transfer unit and an image formation apparatus which are capable of inhibiting a belt member from breaking and enhancing the durability of thereof.

An aspect of the invention is a belt unit that includes: a belt member; a roller rotatably placed on an inner peripheral surface of the belt member; and a meander restraint member facing an edge portion of the belt member and configured to restrain the belt member from meandering while the belt member is running. The edge portion of the belt member comprises a modification layer.

According to the aspect of the invention, when the meander restraint member and an edge portion of the belt member slide over each other, the modification layer is scraped off little by little. This makes it possible to inhibit the meander restraint member from being damaged, and accordingly to inhibit the belt member from breaking.

Consequently, the durability of the image formation apparatus can be enhanced.

BRIEF DESCRIPTION OF THE DRAWINGS

FIG. 5 is a table illustrating an evaluation result of the durability of transfer belts of the first embodiment of the invention.

DETAILED DESCRIPTION OF EMBODIMENTS

Figure 1:
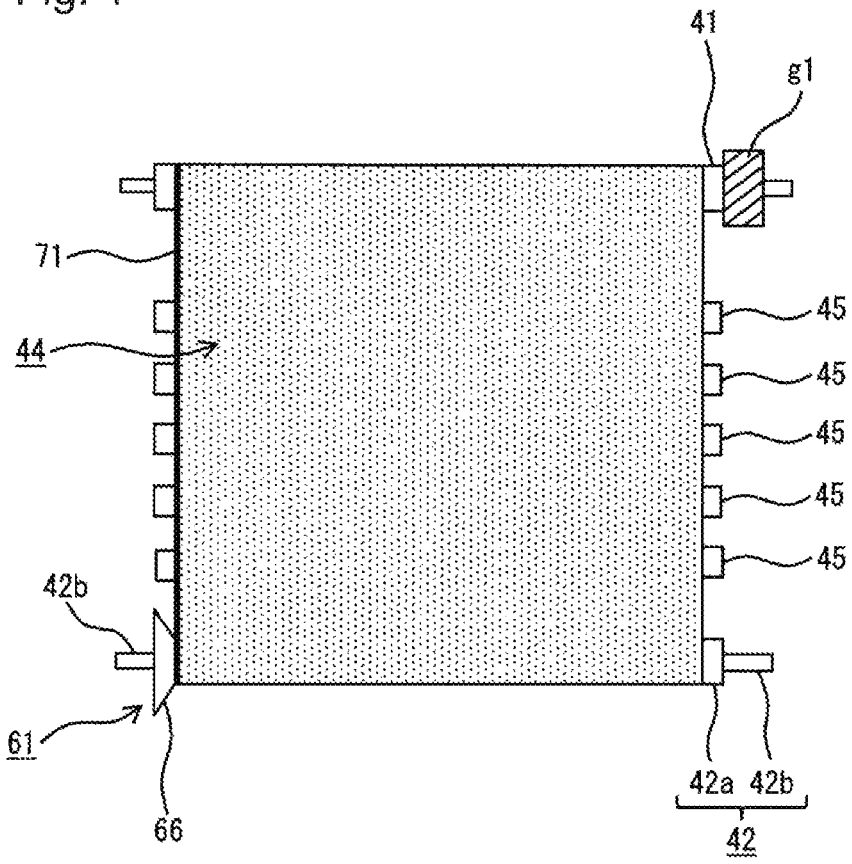
FIG. 1 is a plan view of a transfer belt unit of a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Referring to the drawings, detailed descriptions are hereinbelow provided for image formation apparatuses of embodiments of the invention. As the image formation apparatuses, electrophotographic printers are described for this purpose.

Figure 2:
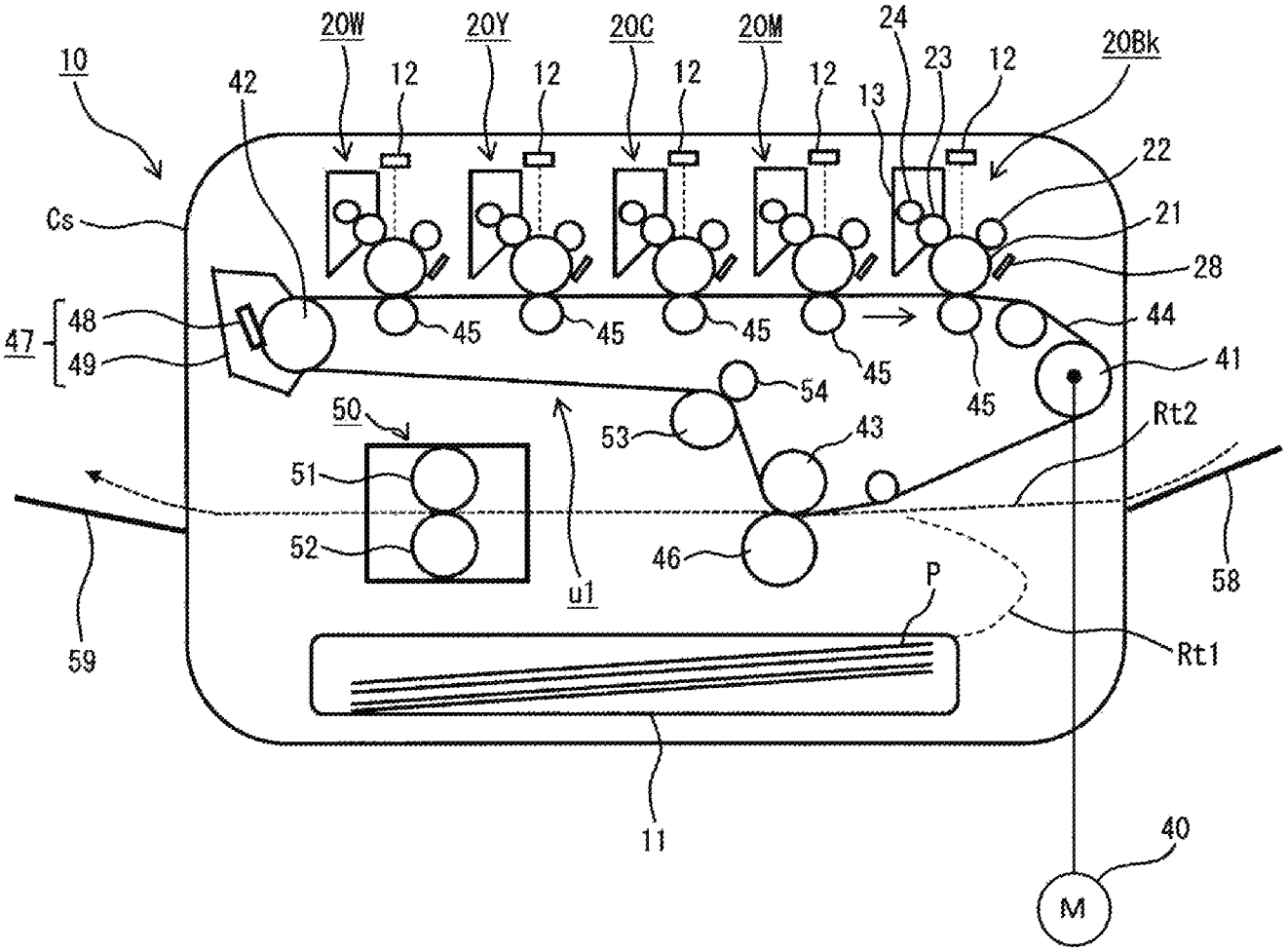
FIG. 2 is a conceptual diagram of a printer of the first embodiment of the invention.
Figure 3:
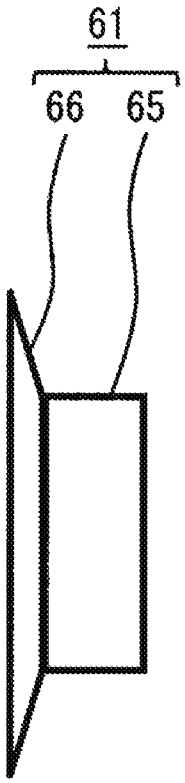
FIG. 3 is a conceptual diagram of a pulley of the first embodiment of the invention.

FIG. 1 is a plan view of a transfer belt unit of a first embodiment of the invention. FIG. 2 is a conceptual diagram of a printer of the first embodiment of the invention. FIG. 3 is a conceptual diagram of a pulley of the first embodiment of the invention.

In the drawings, reference sign 10 denotes a printer, and reference sign Cs denotes a housing of printer 10. A main body of printer 10, or the apparatus main body includes paper sheet cassette 11, as a media container, placed in the lower portion of the main body. Paper sheet cassette 11 contains paper sheets P as media. In addition, a sheet feeder mechanism, although not illustrated, is placed adjacent to a front end of paper sheet cassette 11. The sheet feeder mechanism feeds paper sheets P, on a one-by-one basis, to media conveyance route Rt1 from paper sheet cassette 11 by separating one sheet from another. Although not illustrated, pairs of conveyance rollers, as conveyance members, placed above the sheet feeder mechanism convey each fed paper sheet P along media conveyance route Rt1.

In addition, the apparatus main body includes image formation units 20W, 20Y, 20C, 20M, 20Bk respectively for white, yellow, cyan, magenta and black colors, which are arranged side-by-side in its upper portion from a downstream side to an upstream side in a conveyance direction of paper sheets P. Since image formation units 20W, 20Y, 20C, 20M, 20Bk have the same structure, the structure is described by giving reference signs to only components included in the structure of image formation unit 20Bk in FIG. 2.

Each of image formation units 20W, 20Y, 20C, 20M, 20Bk includes: rotatably-placed photosensitive drum 21 as an image carrier; and LED head 12 as a light exposure device (a light exposer), which is placed above and opposite photosensitive drum 21. LED head 12 irradiates the surface of photosensitive drum 21 with light whose pattern corresponds to print data, and thereby creates an electrostatic latent image as a latent image.

It should be noted that each of image formation units 20W, 20Y, 20C, 20M, 20Bk and corresponding LED head 12 constitute an image formation section configured to form a toner image as a developer image for each color.

Each of image formation units 20W, 20Y, 20C, 20M, 20Bk further includes: toner cartridge 13 as a developer container, configured to contain a toner as a developer for the corresponding color; rotatably-placed charge roller 22 as a charge device, configured to uniformly electrically charge the surface of photosensitive drum 21; rotatably-placed development roller 23 as a developer carrier, configured to make a toner adhere to photosensitive drum 21, and to develop the electrostatic latent image to create the toner image; toner supply roller 24 as a developer supply member, configured to supply the toner to development roller 23; and cleaning blade 28 as a cleaning member, configured to clean photosensitive drum 21 by scraping toner remaining on photosensitive drum 21 after a primary transfer (described later). The toner remaining may also be referred to as a residual toner or a residual developer.

In addition, the apparatus main body includes transfer unit u1 placed under image formation units 20W, 20Y, 20C, 20M, 20Bk. Transfer unit u1 includes: drive roller 41 as a first roller, which is rotatably placed near image formation unit 20Bk, and which is connected to motor (M) 40 as a drive unit via gear g1 and is rotated by the rotation of motor 40; driven roller (idle roller) 42 as a second roller, which is rotatably placed near image formation unit 20W, and which is rotated by the rotation of drive roller 41; secondary transfer backup roller 43 as a third roller and as a first backup roller, which is rotatably placed lower than drive roller 41 and driven roller 42, and which is rotated by the rotation of drive roller 41 and driven roller 42; transfer belt 44 as a belt member and as an intermediate transfer medium, which is suspended among drive roller 41, driven roller 42 and secondary transfer backup roller 43 in a runnable manner, and which is made, by the rotation of drive roller 41, driven roller 42 and secondary transfer backup roller 43, to run along image formation units 20W, 20Y, 20C, 20M, 20Bk in a direction indicated with an arrow; transfer rollers 45 as first transfer members, which are placed opposite to photosensitive drums 21 of image formation units 20W, 20Y, 20C, 20M, 20Bk with transfer belt 44 interposed between transfer rollers 45 and photosensitive drums 21; transfer roller 46 as a second transfer member, which is placed opposite secondary transfer backup roller 43 with paper sheet P and transfer belt 44 interposed between transfer roller 46 and secondary transfer backup roller 43; cleaning device 47 which is placed opposite to driven roller 42 with transfer belt 44 interposed between cleaning device 47 and driven roller 42; reversely-bent roller 53 as a reversely-bent member, which is rotatably placed downstream of secondary transfer backup roller 43 and upstream of driven roller 42 in a running direction of transfer belt 44 while being in pressure contact with an outer surface of transfer belt 44, and which is rotated together with transfer belt 44 by the run of transfer belt 44 (in a forward direction); and reversely-bent backup roller 54 as a second backup roller, which is placed opposite to reversely-bent roller 53 with transfer belt 44 interposed between reversely-bent backup roller 54 and reversely-bent roller 53, and which is rotated (in a forward direction) together with transfer belt 44 by the run of transfer belt 44.

In the embodiment, in the primary transfer sections formed between transfer rollers 45 and photosensitive drums 21, transfer rollers 45 sequentially transfer (primarily-transfer) color toner images, which are formed on photosensitive drums 21, to transfer belt 44 by superimposing one color toner image on another to create a full-colored toner image on transfer belt 44.

Thereafter, in a secondary transfer section formed between transfer roller 46 and transfer backup roller 43, transfer roller 46 transfers (secondarily-transfers) the full-colored toner image, which is formed on transfer belt 44, to paper sheet P to create the full-colored toner image on paper sheet P.

Cleaning device 47 includes: cleaning blade 48 as a cleaning member, which is placed with its front end pressed against transfer belt 44 with a certain pressure; and residual toner box 49 as a residual developer container. Cleaning blade 48 cleans transfer belt 44 by scraping residual toner which remains on transfer belt 44 after the secondary transfer. Residual toner box 49 contains the thus-scraped residual toner.

Meanwhile, reversely-bent roller 53 and reversely-bent backup roller 54 are placed to prevent paper sheet P from going out of position during the formation of the image on paper sheet P.

In addition, fixation device 50 as a fixation unit is placed downstream of the secondary transfer section in media conveyance route Rt1. Fixation device 50 includes: heat roller 51 as a first fixation member, which includes a heater (not illustrated) like a halogen lump, as a heat source, in its inside; and press roller 52 as a second fixation member, which is placed in contact with heat roller 51. Fixation device 50 heats and presses the full-colored toner image on paper sheet P, which is conveyed from the secondary transfer section, to fix the full-colored toner image to paper sheet P, and thereby creates the full-colored image.

Moreover, upstream of the secondary transfer section in media conveyance route Rt1, sheet feeder tray (multi-purpose tray) 58 as a first media placement unit is placed in order to feed paper sheets P, which are different from paper sheets P contained in paper sheet cassette 11, to the secondary transfer section via media conveyance route Rt2. Downstream of fixation device 50 in media conveyance route Rt1, delivery tray 59 as a second media placement unit is placed in order to deliver paper sheet P with the full-colored image formed thereon to the outside of the apparatus main body.

It should be noted that the main component of transfer belt 44 is polyamide-imide. An appropriate amount of carbon black is added to the polyamide-imide in order to make the polyamide-imide electrically conductive. The polyamide-imide and the thus-added carbon black are mixed and agitated in an N-methylpyrrolidone solution. The obtained resin material is injected into a cylindrical mold. The thus-injected resin material is heated at a temperature of not less than 90° C. but not greater than 120° C. for a predetermined time length while rotating the mold, and thereafter is cooled. Thereby, a belt raw tube is molded in the mold. The belt raw tube taken out of the mold is cut into a predetermined width to be formed into transfer belt 44.

Next, descriptions are provided for how image formation units 20W, 20Y, 20C, 20M, 20Bk and transfer unit u1 work.

In each of image formation units 20W, 20Y, 20C, 20M, 20Bk, charge roller 22 uniformly electrically charges the surface of photosensitive drum 21; and thereafter, LED head 12 irradiates the surface of photosensitive drum 21 with the light whose pattern corresponds to the print data, and thereby creates the electrostatic latent image.

Meanwhile, the toner is supplied from toner cartridge 13, and is retained by toner supply roller 24. The toner is supplied to development roller 23. When part of the surface of photosensitive drum 21 on which the electrostatic latent image is formed reaches development roller 23, the toner attaches to photosensitive drum 21 because of an electric potential difference between the electrostatic latent image on photosensitive drum 21 and development roller 23. Thereby, the toner image is formed on photosensitive drum 21.

In addition, in transfer unit u1, transfer belt 44 is running. In the primary transfer sections, transfer rollers 45 sequentially transfer the respective color toner images to transfer belt 44 by superimposing one color toner image on another to create the full-colored toner image on transfer belt 44. In the secondary transfer section, transfer roller 46 transfers the full-colored toner image to paper sheet P to create the full-colored toner image on paper sheet P.

As described above, the embodiment is such that the driving of motor 40 rotates drive roller 41, driven roller 42 and secondary transfer backup roller 43 and the like to make transfer belt 44 run. Because of the structure of transfer unit u1, if while running, transfer belt 44 meanders by moving in its width direction, the full-colored toner image cannot be properly transferred to paper sheet P. This resultantly lowers the image quality.

With this taken into consideration, facing one width-direction edge portion 71 of transfer belt 44, pulley 61 as a meander restraint member configured to prevent transfer belt 44, while running, from meandering by moving in its width direction is provided to an end portion of at least one of drive roller 41 and driven roller 42 placed to an inner peripheral surface of transfer belt 44, specifically on a left end portion of driven roller 42 in the running direction of transfer belt 44 in the embodiment. Incidentally, pulley 61 is made of polyacetal.

As illustrated in FIG. 1, driven roller 42 includes: a main body of driven roller 42, or roller main body 42*a*; and rotary shafts 42*b* as support shafts formed as projecting from the two ends of roller main body 42*a*, and extending along the axis of driven roller 42. Pulley 61 is attached to left rotary shaft 42*b*.

Pulley 61 includes: core portion 65 whose diameter is equal to that of roller main body 42*a*; and cone-shaped belt receiver 66 formed adjacent to core portion 65. The diameter of belt receiver 66 becomes larger as belt receiver 66 becomes further from core portion 65.

Once left edge portion 71 of transfer belt 44 comes into contact with belt receiver 66 as a result of transfer belt 44 moving in the width direction, pulley 61 blocks transfer belt 44 from moving further in the width direction. Thus, the meandering of transfer belt 44 can be prevented. Drive roller 41, driven roller 42, transfer belt 44, pulley 61 and the like constitute the transfer belt unit as the belt unit.

It should be noted that the angle of belt receiver 66 to a direction at a right angle to rotary shaft 42*b* is set at 15 degrees.

Meanwhile, in a case where one width-direction edge portion 71 of transfer belt 44 repeatedly contacts with and slides over belt receiver 66, there is the likelihood that transfer belt 44 will damage pulley 61. In this case, a damaged part of pulley 61 becomes scraped, and pulley 61 locally wears away. Thereafter, if transfer belt 44 enters and becomes caught by the worn-away part of pulley 61, transfer belt 44 bends around edge portion 71, and cracks and breaks due to bending fatigue.

With this taken into consideration, the embodiment is configured to inhibit transfer belt 44 from damaging pulley 61 by: forming a modification layer, or a carbonization layer in the embodiment, in edge portion 71 by subjecting transfer belt 44 to a predetermined treatment; and making the carbonization layer function as a solid lubricant between transfer belt 44 and pulley 61.

The embodiment forms the carbonization layer in edge portion 71 of transfer belt 44 by cutting the belt raw tube, which is taken out of the mold, using a laser process machine.

Figure 4:
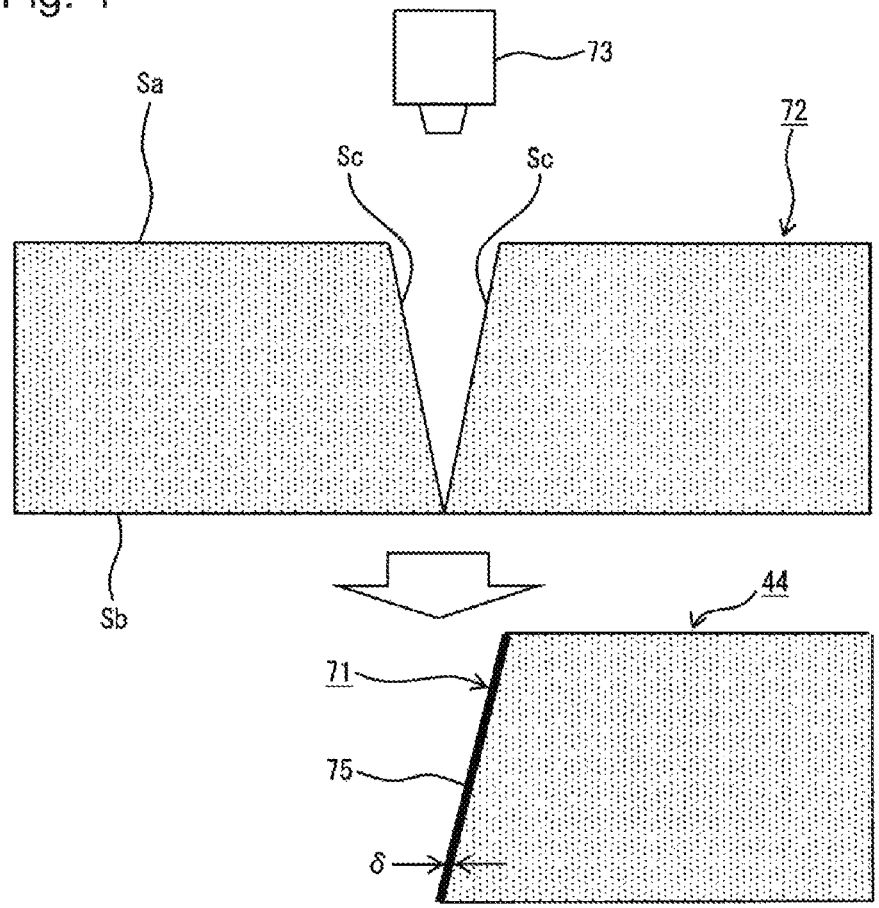
FIG. 4 is a diagram for explaining a method of forming a carbonization layer of the first embodiment of the invention.

FIG. 4 is a diagram for explaining a method of forming the carbonization layer of the first embodiment of the invention.

In the drawing, reference sign 72 denotes the belt raw tube, and reference sign 73 denotes the laser process machine (MD-V9900A, manufactured by Keyence Corporation). Transfer belt 44 is formed by cutting, or burning off, belt raw tube 72 into a predetermined width using a fixed laser process machine 73 while moving belt raw tube 72 in its circumferential direction. During this, carbonization layer 75 is formed in edge portion 71 of transfer belt 44 since the heat of a laser beam carbonizes cut sections Sc.

In this case, the laser beam is cast onto front surface Sa of belt raw tube 72 in a direction perpendicular to front surface Sa thereof. For this reason, the diameter of the laser beam becomes smaller as the laser beam becomes closer to back surface Sb of belt raw tube 72. Thus, cut sections Sc incline to front surface Sa and back surface Sb of belt raw tube 72, and carbonization layer 75 to be formed in transfer belt 44 also inclines.

Next, descriptions are provided for the relationship between thickness δ of each carbonization layer 75 and the durability of corresponding transfer belt 44.

FIG. 5 is a table illustrating an evaluation result of the durability of transfer belts of the first embodiment of the invention.

For each of carbonization layers 75 with their respective thicknesses δ of 0 μm, 2 μm, 5 μm and 10 μm, FIG. 5 illustrates: the presence or absence of a break in transfer belt 44; an amount of wear of pulley 61; and an evaluation result of the durability of transfer belt 44. Incidentally, thickness δ of each carbonization layer 75 is measured using a scanning electron microscope (S-2380N manufactured by Hitachi, Ltd.). An increase in the intensity of the laser beam to be used to cut belt raw tube 72 makes it possible to increase the thickness δ of the carbonization layer 75.

How many times transfer belt 44 turns before its break is measured by: setting the thickness of transfer belt 44 used for the measurement at 83 μm; and making transfer belt 44 run at a circumferential speed of 300 mm/sec without printing, with edge portion 71 of transfer belt 44 pressed against belt receiver 66 at a lateral pressure of 800 gf. In addition, the amount of wear of pulley 61, which causes the break of transfer belt 44, is measured using a 3D measuring instrument (NH-5N, manufactured by Mitaka Kohki Co., Ltd.).

Meanwhile, carbonization layer 75 formed in edge portion 71 of transfer belt 44 is made of amorphous carbon, and its surface is easily broken. That is, carbonization layer 75 is more brittle than pully 61 and any other part of edge portion 71 of transfer belt 44. For this reason, when pulley 61 and transfer belt 44 slide over each other, carbonization layer 75 is scraped off little by little. Thus, carbonization layer 75 with a larger thickness δ takes a longer time to be all scraped up, and accordingly allows pulley 61 to start to be worn only after a longer time.

The measurement results are as follows. In the case that thickness δ of carbonization layer 75 is 0 μm, transfer belt 44 breaks when it turns 200K (200,000) times; the amount of wear of pulley 61 is 0.50 mm; and the evaluation result of the durability of transfer belt 44 is a failure (No good). In the case where thickness δ of carbonization layer 75 is 2 μm, transfer belt 44 does not break even after it turns 400K (400,000) times; the amount of wear of pulley 61 is 0.07 mm; and the evaluation result of the durability of transfer belt 44 is good (Good). In the case where thicknesses δ of carbonization layers 75 are 5 μm and 10 μm, transfer belts 44 do not break even after they turn 400K (400,000) times; no wear of pulleys 61 is found (0.05 mm or less); and the evaluation results of the durability of transfer belts 44 are good (Good).

It should be noted that it is difficult to make thickness δ of carbonization layer 75 greater than 10 μm in terms of the manufacturing of transfer belts 44. Thus, it is desirable that thickness δ of carbonization layer 75 be set in a range of 2 μm≤δ≤10 μm.

In this case, the Young's modulus of edge portion 71 of transfer belt 44 is 4.5 GPa, while the Young's modulus of pulley 61 is 2.75 Gpa.

Next, descriptions are provided for how pulley 61 wears in a case where no carbonization layer 75 is formed, and for how pulley 61 wears in a case where the carbonization layer 75 is formed.

Figure 6:
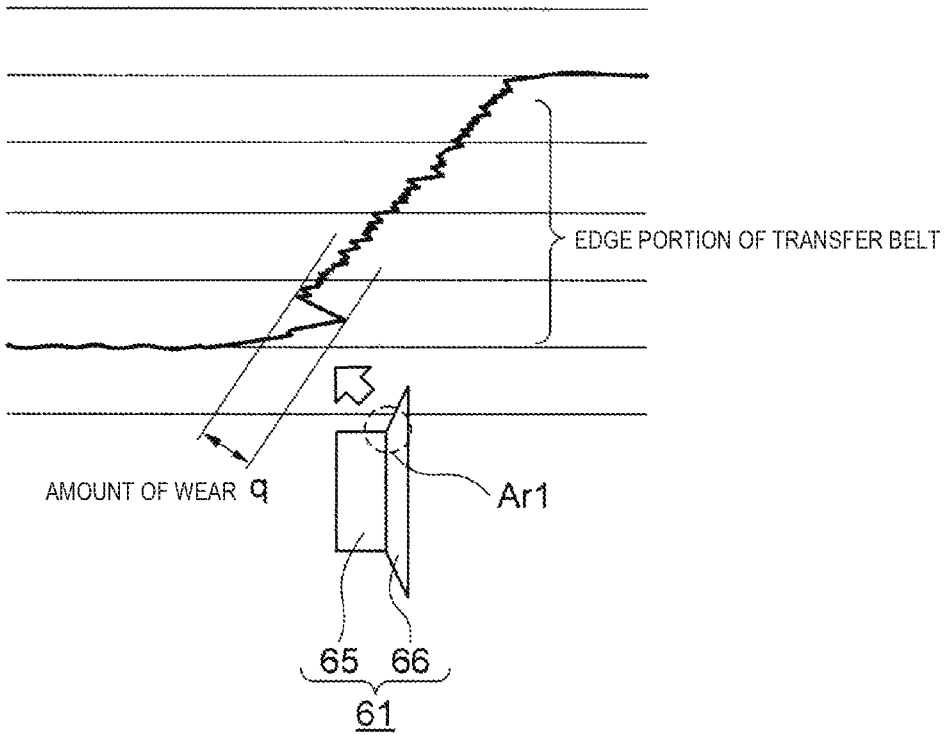
FIG. 6 is a diagram illustrating how a pulley wears in a case where no carbonization layer is formed.

FIG. 6 is a diagram illustrating how a pulley wears in a case where no carbonization layer is formed.

Figure 7:
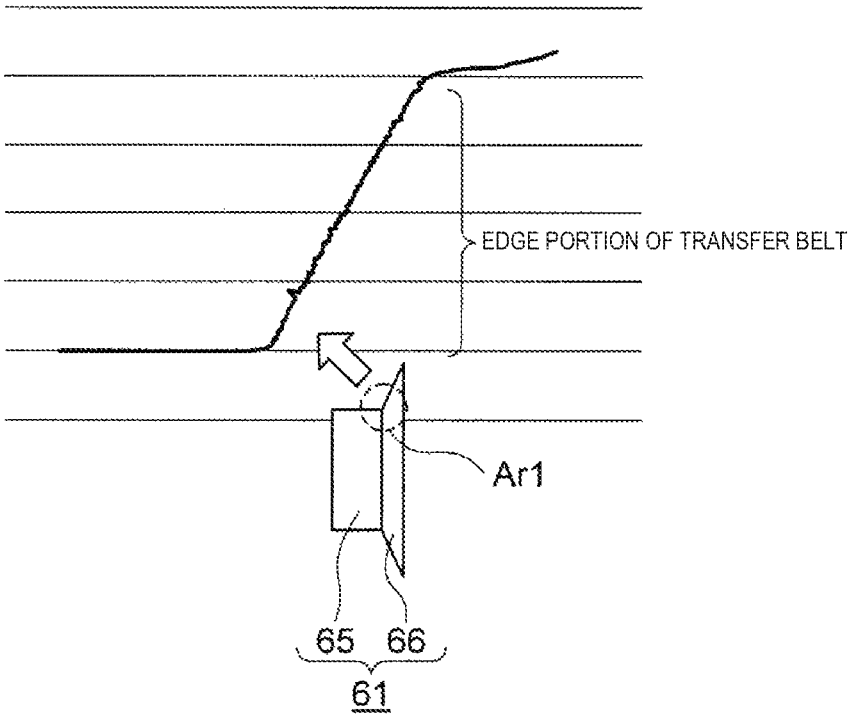
FIG. 7 is a diagram illustrating how the pulley of the first embodiment of the invention wears.

FIG. 7 is a diagram illustrating how the pulley of the first embodiment of the invention wears.

In the case where no carbonization layer 75 is formed, area Ar1 between core portion 65 and belt receiver 66 of pulley 61 wears in wear amount q, as illustrated in FIG. 6. In contrast, in the case where the carbonization layer 75 is formed, area Ar1 between core portion 65 and belt receiver 66 of pulley 61 does not wear, as illustrated in FIG. 7.

As described above, the embodiment is configured such that: carbonization layer 75 is formed in edge portion 71 of transfer belt 44; and when pulley 61 and transfer belt 44 slide over each other, carbonization layer 75 is scraped off little by little. This makes it possible to inhibit pulley 61 from being damaged, and to inhibit transfer belt 44 from breaking.

Accordingly, the life of transfer belt 44 can be extended, and the durability of printer 10 can be enhanced.

Furthermore, because carbonization layer 75 is scraped evenly, the surface of edge portion 71 with its carbonization layer 75 scraped becomes smooth so that no splinter or step remain on the surface of edge portion 71. As a result, it is possible to more greatly inhibit transfer belt 44 from damaging pulley 61.

Next, descriptions are provided for a second embodiment of the invention in which the toner images respectively formed on photosensitive drums 21 (FIG. 2) are directly transferred to paper sheet P. Incidentally, components having the same structures as those of the first embodiment are denoted by the same reference signs, and effects of the invention attributable to the same structures are incorporated herein by reference to have the same effects as those of the first embodiment.

Figure 8:
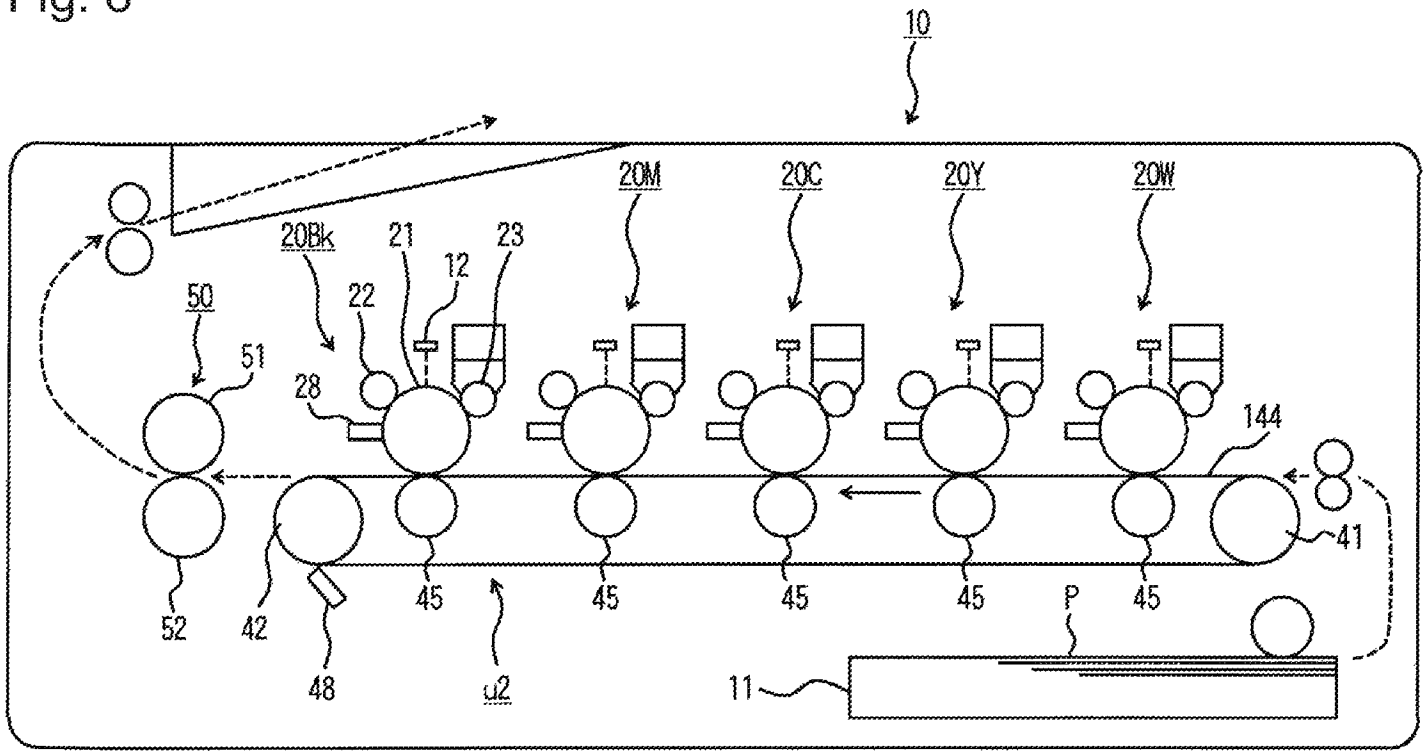
FIG. 8 is a conceptual diagram of a printer of a second embodiment of the invention.

FIG. 8 is a conceptual diagram of a printer of the second embodiment of the invention.

In the drawing, 20W, 20Y, 20C, 20M, 20Bk denote image formation units for white, yellow, cyan, magenta and black colors, respectively. Image formation units 20W, 20Y, 20C, 20M, 20Bk are arranged side-by-side from the upstream side to the downstream side in the conveyance direction of paper sheets P as the media.

Transfer unit u2 is placed under image formation units 20W, 20Y, 20C, 20M, 20Bk. Transfer unit u2 includes: drive roller 41 as a first roller, which is rotatably placed near image formation unit 20W, and which is rotated by the rotation of motor 40 (FIG. 2), as a drive unit; driven roller (idle roller) 42 as a second roller, which is rotatably placed near image formation unit 20Bk, and which is rotated by the rotation of drive roller 41; transfer belt 144 as a belt member, which is suspended between drive roller 41 and driven roller 42 in a runnable manner, and which is made, by the rotation of drive roller 41 and driven roller 42, to run along image formation units 20W, 20Y, 20C, 20M, 20Bk in a direction indicated with an arrow; and transfer rollers 45 as transfer members, which are placed opposite to photosensitive drums 21 as image carriers of image formation units 20W, 20Y, 20C, 20M, 20Bk with transfer belt 144 interposed between transfer rollers 45 and photosensitive drums 21.

In this case, transfer belt 144 is formed by burning off belt raw tube 72 into a predetermined width using fixed laser process machine 73 (FIG. 4) while moving belt raw tube 72 in its circumferential direction, as in the case of the first embodiment. During this, carbonization layer 75 is formed in edge portion 71 of transfer belt 144 since the heat of a laser beam carbonizes cut sections Sc.

The relationship between thickness δ of carbonization layer 75 and the durability of transfer belt 144 is the same as that in the first embodiment. It is desirable that thickness δ of carbonization layer 75 be set in a range of 2 μm≤δ≤10 μm.

In the foregoing embodiments, carbonization layer 75 as the modification layer is formed in edge portion 71 of transfer belts 44, 144. However, a layer whose hardness is less than that of carbonization layer 75 may be formed as the modification layer.

Furthermore, although in each foregoing embodiment pulley 61 as the meander restraint member is fixed to rotary shaft 42*b* as the support shaft, pulley 61 may be provided to rotary shaft 42*b* such that pulley 61 is unmovable in the axial direction of rotary shaft 42*b*, and is rotatable in the rotational direction of rotary shaft 42*b*.

Moreover, although in each foregoing embodiment pulley 61 is placed on rotary shaft 42*b*, pulley 61 may be place on a rotary member different from rotary shaft 42*b*, or on the support member configured to support each of transfer belt 44, 144.

Besides, although each foregoing embodiment describes printer 10, the invention is applicable to a copy machine, a facsimile machine, a multifunction machine and the like.

In addition, although the foregoing embodiments describe transfer belts 44, 144 of transfer units u1, u2, the invention is applicable to a photosensitive belt, a fixation belt, a transfer belt and the like.

It should be noted that: the invention is not limited to the foregoing embodiments; and the invention can be variously modified based on the gist of the invention, and such modifications shall not be excluded from the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A belt unit comprising:

a belt member;

a roller rotatably placed on an inner peripheral surface of the belt member; and a meander restraint member facing an edge portion of the belt member and configured to restrain the belt member from meandering while the belt member is running, wherein the edge portion of the belt member comprises a modification layer, wherein the modification layer functions as a solid lubricant.

2. A transfer unit comprising:

the belt unit according to claim 1; and a transfer member rotatably placed on the inner peripheral surface of the belt member, and opposite an image carrier of an image formation section with the belt member between the transfer member and the image carrier.

3. An image formation apparatus comprising:

an image formation unit which forms a developer image; and the transfer unit according to claim 2, which transfers the developer image to the belt member of the transfer unit, or to a medium conveyed by the belt member.

4. The belt unit according to claim 1, wherein the modification layer comprises a carbonization layer.

5. A belt unit comprising:

a belt member;

a roller rotatably placed on an inner peripheral surface of the belt member; and a meander restraint member facing an edge portion of the belt member and configured to restrain the belt member from meandering while the belt member is running, wherein the edge portion of the belt member comprises a modification layer, wherein the modification layer is formed by subjecting the belt member to a predetermined treatment.

6. The belt unit according to claim 5, wherein the meander restraint member is provided to an end portion of the roller.

7. A transfer unit comprising:

the belt unit according to claim 5; and a transfer member rotatably placed on the inner peripheral surface of the belt member, and opposite an image carrier of an image formation section with the belt member between the transfer member and the image carrier.

8. An image formation apparatus comprising:

an image formation unit which forms a developer image; and the transfer unit according to claim 7, which transfers the developer image to the belt member of the transfer unit, or to a medium conveyed by the belt member.

9. The belt unit according to claim 5, wherein the modification layer comprises a carbonization layer and the carbonization layer is formed by burning off a belt raw member.

10. A belt unit comprising:

a belt member;

a roller rotatably placed on an inner peripheral surface of the belt member; and a meander restraint member facing an edge portion of the belt member and configured to restrain the belt member from meandering while the belt member is running, wherein the edge portion of the belt member comprises a modification layer, wherein a thickness $\delta$ of the modification layer is in a range of $2\ \mu m \leq \delta \leq 10\ \mu m$.

11. A transfer unit comprising:

the belt unit according to claim 10; and a transfer member rotatably placed on the inner peripheral surface of the belt member, and opposite an image carrier of an image formation section with the belt member between the transfer member and the image carrier.

12. An image formation apparatus comprising:

an image formation unit which forms a developer image; and the transfer unit according to claim 11, which transfers the developer image to the belt member of the transfer unit, or to a medium conveyed by the belt member.

13. A belt unit comprising:

a belt member;

a roller rotatably placed on an inner peripheral surface of the belt member; and a meander restraint member facing an edge portion of the belt member and configured to restrain the belt member from meandering while the belt member is running, wherein the edge portion of the belt member comprises a modification layer, wherein the modification layer comprises a carbonization layer.

14. The belt unit according to claim 13, wherein the carbonization layer is formed by burning off a belt raw member.

15. The belt unit according to claim 13, wherein the carbonization layer includes amorphous carbon.

16. A transfer unit comprising:

the belt unit according to claim 13; and a transfer member rotatably placed on the inner peripheral surface of the belt member, and opposite an image carrier of an image formation section with the belt member between the transfer member and the image carrier.

17. An image formation apparatus comprising the transfer unit according to claim 16.

18. An image formation apparatus comprising:

an image formation unit which forms a developer image; and the transfer unit according to claim 16, which transfers the developer image to the belt member of the transfer unit, or to a medium conveyed by the belt member.

19. The belt unit according to claim 13, wherein a thickness $\delta$ of the modification layer is in a range comprising $2\ \mu m \leq \delta \leq 10\ \mu m$.

* * * * *